United States Patent [19]

Bury

[11] Patent Number: 4,739,909

[45] Date of Patent: Apr. 26, 1988

[54] HAT SIZE MAINTAINER

[76] Inventor: John S. Bury, 16749 Southfield Rd., Allen Park, Mich. 48101

[21] Appl. No.: 911,374

[22] Filed: Sep. 25, 1986

[51] Int. Cl.[4] ..... D06C 5/00; A47G 25/10

[52] U.S. Cl. ..... 223/15; 223/25; 223/52

[58] Field of Search ..... 223/24, 25, 26, 52, 223/15, 61, 63, 65, 88, 74, 77, 80; 38/103, 107, 140, 102.5; 211/116, 119, 30

[56] References Cited

U.S. PATENT DOCUMENTS

| | | | |
|---|---|---|---|
| 362,495 | 5/1887 | Crommer | 223/63 X |
| 456,286 | 7/1891 | Denzer . | |
| 541,869 | 7/1895 | Mayer | 38/102.5 |
| 769,477 | 9/1904 | Gray . | |
| 831,484 | 9/1906 | Strange | 211/119 |
| 961,418 | 6/1910 | Lloyd . | |
| 1,453,697 | 5/1923 | Bass | 38/140 |
| 1,634,051 | 6/1927 | Parsch | 223/15 X |
| 2,107,961 | 2/1938 | Seiler | 223/25 |
| 2,835,421 | 5/1958 | Marchese | 223/61 |
| 2,935,237 | 4/1959 | Seiler | 223/25 |
| 3,435,475 | 4/1969 | Bisk . | |
| 3,459,347 | 8/1969 | Navara | 223/25 |
| 4,011,973 | 3/1977 | Leach | 223/84 |
| 4,593,839 | 6/1986 | Vandoros | 223/63 |
| 4,673,113 | 6/1987 | Vandewege | 223/15 |

FOREIGN PATENT DOCUMENTS

| | | | |
|---|---|---|---|
| 458526 | 8/1949 | Canada | 223/77 |

*Primary Examiner*—Andrew M. Falik
*Attorney, Agent, or Firm*—Basile, Hanlon

[57] ABSTRACT

A hat size maintainer includes first and second arcuately shaped members configured to the shape of the interior surface of the headband of a hat or cap. First and second adjustable members, one end of each being attached to one of the first and second arcuately shaped members are adjustably joinable to enable the spacing between the first and second arcuately shaped members to be varied for different hat or cap sizes.

1 Claim, 2 Drawing Sheets

HAT SIZE MAINTAINER

BACKGROUND OF THE INVENTION

1. Field of the Invention

The present invention relates, in general, to wearing apparel and, more specifically, to devices for maintaining the shape of wearing apparel, such as hats and caps.

2. Description of the Prior Art

In order to maintain the correct size and shape of a piece of wearing apparel, such as a hat, etc., it is known to provide a device which is insertable into the article when not in use which has the original size and shape of the article.

A variety of hat conformers and stretchers have been previously constructed. Each of these devices generally involves a number of pieces or elements which engage the interior surface of the crown or band of the hat and are adjustable by means of threaded screws, etc., to enable the user to conform the hat stretcher to the size or shape of the hat. However, the known hat size maintainers are relatively complex in construction thereby resulting in a high cost. Thus, it would be desirable to provide a hat size maintainer which overcomes these problems and provides a quick and inexpensive device for maintaining the size of an article of wearing apparal such as a hat or cap.

SUMMARY OF THE INVENTION

The present invention is a hat size maintainer which is used to maintain the correct size of a hat or cap when it is not being worn by the user. The hat size maintainer includes first and second arcuately shaped members having a generally circular configuration which are adjustably engageable with the inside crown or band of the hat. First and second adjustable members are respectively connected to the first and second arcuately shaped members and extend inward therefrom. Adjusting means are provided for connecting the first and second adjustable members together and to vary the spacing between the first and second arcuately shaped members. This enables the spacing between the first and second arcuately shaped members to be varied depending upon the particular hat size. In one embodiment, the first and second adjustable members comprise planar bars which are attached at one end to each of the first and second arcuately shaped members, respectively. In another embodiment, the first and second adjustable members comprise an arcuately or channel shaped strip attached at one end to one of the arcuate members which slidably and adjustably receives the legs of an elongated U-shaped rod attached to the opposite arcuate member and having its outer ends insertable into aligned apertures in the strip.

A plurality of apertures are formed in the first and second adjustable members and receive a pin or a fastener, such as a threaded wing nut, etc., to secure the first and second adjustable members in the desired aligned position.

The present hat size maintainer provides a simple and inexpensive device for maintaining the correct size of a hat or cap when the hat or cap is not in use. Also,it may be used to expand the size of a hat which has shrunk back from its original size.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
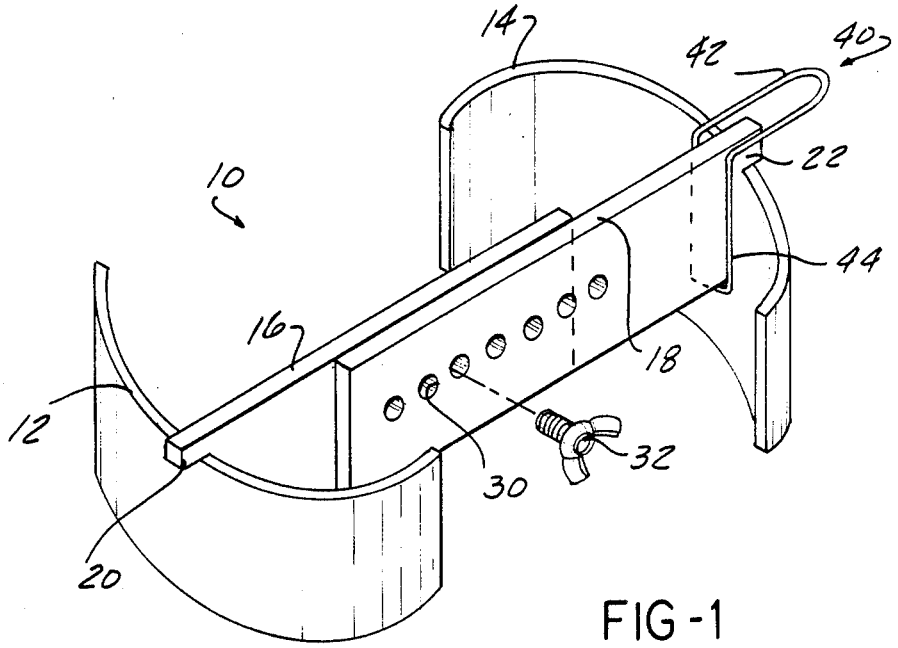
FIG. 1 is a perspective view of one embodiment of the hat size maintainer of the present invention.

Throughout the following description and drawing the same reference number is used to identify the same component throughout the various figures of the drawing.

Figure 2:
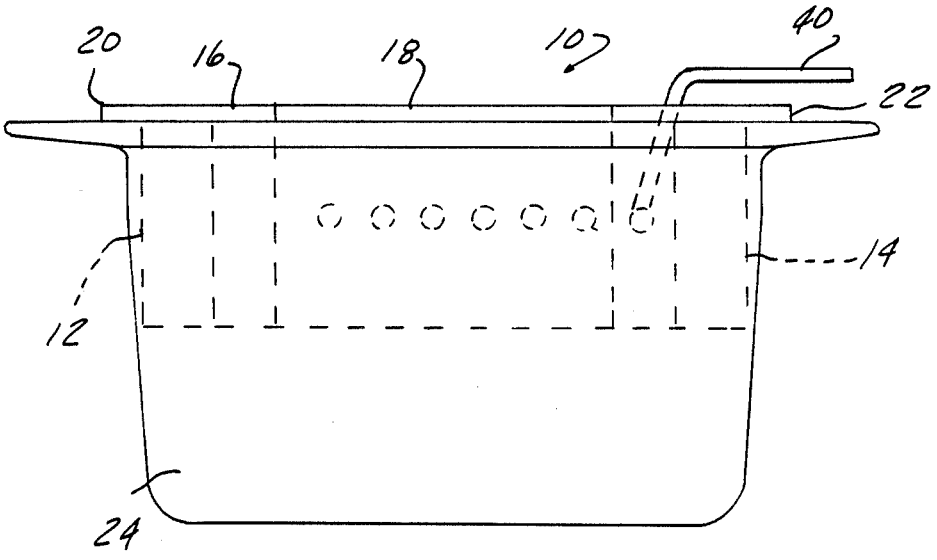
FIG. 2 is a side elevational view of the hat size maintainer shown in FIG. 1.

Referring now to the drawing and in particular to FIGS. 1 and 2, there is illustrated one embodiment of the present hat size maintainer 10. The hat size maintainer includes first and second arcuately shaped members 12 and 14, respectively. Each of the arcuately shaped members 12 and 14 has a generally circular configuration and may be formed of any suitable material, such as metal, plastic, etc. The shape of the arcuate members 12 and 14 is configured to that of the inside headband of a typical men's or ladies' hat or cap so as to engage the interior surface of the headband of the hat.

First and second adjustable members 16 and 18, respectively, are mounted at one end to each of the arcuate members 12 and 14, respectively. The adjustable members 16 and 18 have a generally rectangular, planar configuration. Each of the adjustable members 16 and 18 has an outwardly extending projection or flange 20 and 22, respectively. The flange overlies the upper edge of the arcuately shaped member 12 and 14, respectively, and extends outward beyond the outer surface or periphery of the arcuate members 12 and 14 as shown in FIGS. 1 and 2. The projections or flanges 20 and 22 engage the brim of a hat or cap 24 when the size maintainer 10 is positioned at the headband of the hat as shown in FIG. 2. This insures that the hat or cap 24 is securely and stationarily mounted on the hat size maintainer 10 with the headband at the set size.

Means are also provided for adjustably connecting the first and second adjustable members 16 and 18 together. As shown in FIGS. 1 and 2, a plurality of apertures 30 are formed in the adjustable member 18. At least one aperture, not shown, is formed in the first adjustable member 16 which is alignable with a selected one of the apertures 30 in the second member 18 and receives a fastener 32 such as a threaded wing-nut. Thus, overall the length of the two joined adjustable members 16 and 18 can be varied to change the spacing between the arcuate members 12 and 14. It will be understood that any type of fastener may be employed to join the adjustable members 16 and 18 together.

Figure 3:
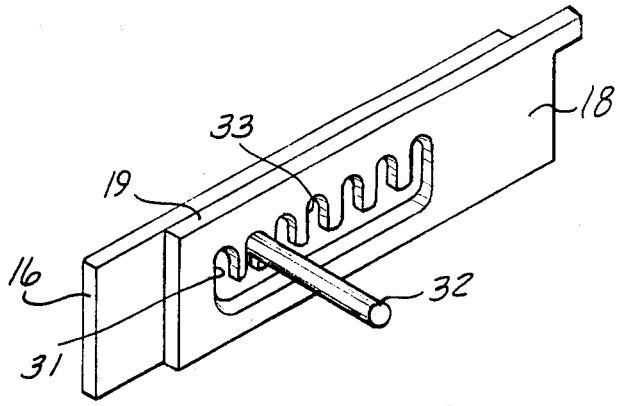
FIG. 3 is an perspective view of an alternate embodiment of the fastener which can be used with the hat size maintainer shown in FIG. 1.

Referring briefly to FIG. 3, an alternate embodiment of the adjustable members, such as member 19, is depicted. In this version, the member 19 is formed with an elongated slot 31 having a plurality of vertically extending slots 33 extending therefrom. The slots 33 are sized to engage the fastener 32 mounted in the member 16 and extending through the member 18 and enable the two members 16 and 18 to be moved lengthwise relative to each other to vary the length between the two arcuate members 12 and 14.

Referring again to FIG. 1, the hat size maintainer 10 also includes a hanger 40 in the form of an elongated rod having a first portion 42 and a second portion 44. The portion 44 is insertable about the end of one of the planar adjustable members 16 or 18 to enable the hat size maintainer 10 to be supported in a vertical position for storage.

Figure 4:
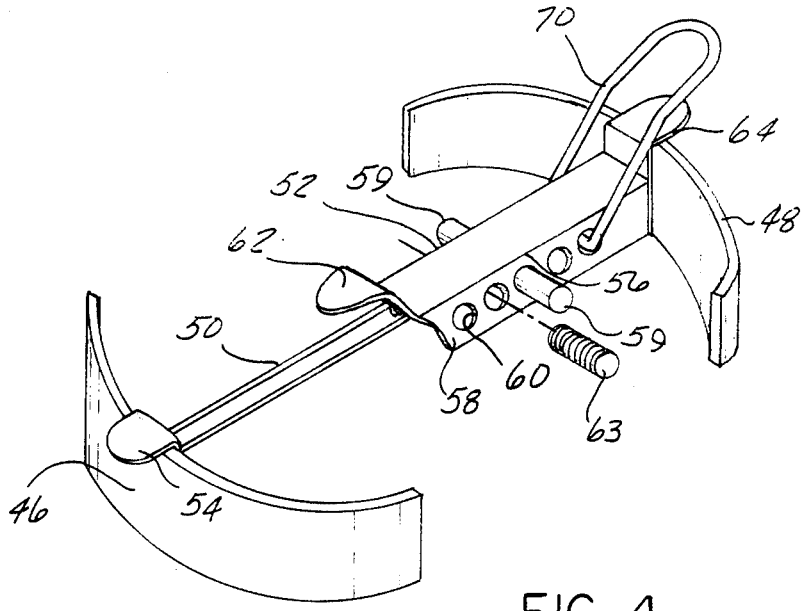
FIG. 4 is a perspective view of another embodiment of the hat size maintainer of the present invention.

Referring now to FIG. 4, there is depicted another embodiment of the present invention which also includes two arcuately shaped members 46 and 48 identically shaped as the arcuate members 12 and 14 described above. The hat size maintainer shown in FIG. 4 is provided with first and second adjustable members 50 and 52, respectively. The first adjustable member 50 is an elongated U-shaped rod with spaced legs. An L-shaped tab 54 is mounted at one end of the first member 50 which overlays and extends outward from the first arcuate member 46 to form a support for the brim of a hat.

The second adjustable member 52 has a generally curved, U-shaped configuration formed with an upper wall 56 and opposed side walls 58. A plurality of spaced apertures 60 are formed in the side walls 58. An outwardly extending tab or flange 62 is formed at one end of the adjustable member 52 to enable the aligned members 50 and 52 to be pivoted about the ends 59 of the first member 50 which extends through the apertures 60 in the second member 52. The ends 59 of the first member 50 are adjustably insertable into any pair of apertures 60 in the side walls 58 of the member 52. A fastener 63, such as a pin, may be inserted through the aligned apertures 60 under the rod 50 to lock the members 50 and 52 together in a desired position. Alternately, the end of the adjustable member 52 may be formed with resilient taps or prongs which releasably engage the legs of the first member so to releasably lock the first and second members 50 and 52 together.

An attachment tab 64 is mounted at one end of the adjustable member 52 and overlays the upper surface of the arcuate surface 48 to provide a support for the opposite portion of the brim of a hat or cap.

A hanger 70 in the form of an elongated rod is provided to support the hat stretcher on a vertical surface. The hanger 70 is preferably in the form of a generally U-shaped strip having inwardly extending ends which engage the apertures 60 in the member 52.

In summary, there has been disclosed a unique hat or cap size maintainer which is inexpensive to manufacture, provides adjustability so as to be usable with various hat and cap sizes and yet enables the hat and cap size to be maintained in its manufactured size or stretched when not in use.

What is claimed is:

1. A hat size maintainer comprising:

first and second arcuately shaped members, each having interior and exterior surfaces;

first and second movably adjustable planar bars, each bar having at least one aperture formed therein, the first adjustable planar bar being attached at one end to the first arcuately shaped member and the second adjustable planar bar being attached at one end to the second arcuately shaped member;

fastening means insertable through aligned aperture in the first and second planar bars for adjustably joining the first and second planar bars together to vary the spacing between the first and second arcuately spaced members; and outwardly extending flanges formed at one end of each of the first and second planar bars for overlying and extending outward from the upper surfaces of the first and second arcuately shaped members.

* * * * *